US010082750B2

(12) United States Patent
Fukui et al.

(10) Patent No.: US 10,082,750 B2
(45) Date of Patent: Sep. 25, 2018

(54) CLEANING DEVICE AND PROCESS CARTRIDGE

(71) Applicant: CANON KABUSHIKI KAISHA, Tokyo (JP)

(72) Inventors: Yuichi Fukui, Yokosuka (JP); Shinjiro Toba, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/628,372

(22) Filed: Jun. 20, 2017

(65) Prior Publication Data

US 2018/0004132 A1 Jan. 4, 2018

(30) Foreign Application Priority Data

Jun. 29, 2016 (JP) ..... 2016-129045

(51) Int. Cl.

| | |
|---|---|
| ***G03G 15/16*** | (2006.01) |
| ***G03G 21/00*** | (2006.01) |
| ***G03G 21/16*** | (2006.01) |
| ***G03G 21/12*** | (2006.01) |
| ***G03G 21/18*** | (2006.01) |
| ***G03G 21/20*** | (2006.01) |

(52) U.S. Cl.

CPC ..... *G03G 15/168* (2013.01); *G03G 21/0011* (2013.01); *G03G 21/12* (2013.01); *G03G 21/1619* (2013.01); *G03G 15/161* (2013.01); *G03G 21/1842* (2013.01); *G03G 21/1882* (2013.01); *G03G 21/206* (2013.01)

(58) Field of Classification Search

CPC . G03G 21/0011; G03G 21/0029; G03G 21/12

See application file for complete search history.

(56) References Cited

U.S. PATENT DOCUMENTS 7,158,749 B2 * 1/2007 Ueno ..... G03G 21/181 399/350
2007/0230989 A1 * 10/2007 Maeda ..... G03G 15/161 399/92

FOREIGN PATENT DOCUMENTS

JP 11184352 A * 7/1999
JP 2002-341721 A 11/2002

OTHER PUBLICATIONS

Machine Tranlation of JP 11-184352 A obtained on Dec. 26, 2017.*

* cited by examiner

*Primary Examiner* — Gregory H Curran
(74) *Attorney, Agent, or Firm* — Canon U.S.A., Inc. IP Division

(57) ABSTRACT

A cleaning device detachable from an image forming apparatus, the cleaning device including a frame that includes a waste toner containing unit that contains toner removed with a cleaning member, a vent hole that communicates an inside and an outside of the waste toner containing unit and that is covered with a filter, and a partitioning portion that protrudes inside the waste toner containing unit. In a state in which the cleaning device in mounted in the image forming apparatus, there is a contact position where the image bearing member and the cleaning member come in contact with each other, and the partitioning portion is positioned between the vent hole and the contact position in a vertical direction.

10 Claims, 8 Drawing Sheets

CLEANING DEVICE AND PROCESS CARTRIDGE

BACKGROUND

Field of the Disclosure

The present disclosure relates to a cleaning device and a process cartridge that are detachably mounted in an electrophotographic image forming apparatus (hereinafter, referred to as an image forming apparatus).

Note that the image forming apparatus is an apparatus that forms an image on a recording medium using an electrophotographic image forming process. The image forming apparatus includes an electrophotographic copying machine, an electrophotographic printer (an LED printer a laser printer, and the like), an electrophotographic facsimile machine, and an electrophotographic word processor.

Furthermore, the cleaning device includes a cleaning member that removes toner on an electrophotographic photosensitive drum (hereinafter, referred to as a photosensitive drum) serving as an image bearing member.

Furthermore, the process cartridge is a member in which a photosensitive drum and at least the cleaning device serving as a process member that acts on the photosensitive drum are formed into a cartridge in an integrated manner, and is a member that is detachably mounted on a main body of the image forming apparatus.

Description of the Related Art

Hitherto, in an image forming apparatus using an electrophotographic image forming process, a process cartridge system is employed in which the photosensitive drum and a process member that acts on the photosensitive drum are formed into a cartridge in an integrated manner, and in which the cartridge is detachable from the image forming apparatus. The process cartridge system notably improves the ease in operation since maintenance of the image forming apparatus can be performed by the user without the need for a service person.

There is a process cartridge that includes, in the image forming apparatus, a cleaning member that removes toner that has remained on the photosensitive drum after the toner image formed on the photosensitive drum has been transferred to a recording medium. Furthermore, as the cleaning member, there is known a cleaning member that adopts a cleaning blade system in which an elastic blade is abutted against a surface of the photosensitive drum at a predetermined pressure to remove the toner on the surface of the photosensitive drum. Specifically, in the cleaning blade system, a cleaning member in which a blade formed of rubber is attached to a distal end of a support member formed of a metal plate is used. The blade can be abutted against the surface of the photosensitive drum at the predetermined pressure and the toner remaining on the photosensitive drum can be removed by attaching the support member to the frame with a screw or the like and fixing the cleaning member. The toner removed with the cleaning members is contained in a waste toner containing unit provided in the frame. (Japanese Patent Laid-Open No. 2002-341721).

In recent years, a need for a high-quality image is increasing in image forming apparatuses, and in order to form a high-quality image, the particles of the toner are made finer, and the particles of the toner contained in the waste toner containing unit have, compared with before, become finer as well. Accordingly, in order to prevent the toner particles that have been made finer from leaking out from the waste toner containing unit, a highly airtight sealing member is used in the sealing member installed in the waste toner containing unit, such that recent waste toner containing units are, compared with before, more airtight. As a result, a difference in atmospheric pressure is created between the inside and the outside of the waste toner containing unit, and there is a concern of the toner leaking out to the outside of the waste toner containing unit together with the air leaking out therefrom.

Accordingly, the present disclosure provides a cleaning device that suppresses increase in pressure inside the waste toner containing unit in a stable manner and in which the toner does not leak out from the waste toner containing unit.

SUMMARY

The disclosure according to the present application is a cleaning device detachable from an image forming apparatus. The cleaning device includes an image bearing member, a cleaning member that removes toner on the image bearing member, and a frame that rotationally supports the image bearing member, and that supports the cleaning member. In the cleaning device, the frame includes a waste toner containing unit that contains the toner removed with the cleaning member, a vent hole that communicates an inside and an outside of the waste toner containing unit and that is covered with a filter, and a partitioning portion that protrudes inside the waste toner containing unit, and in a state in which the cleaning device is mounted in the image forming apparatus, the partitioning portion is, in a vertical direction, positioned between a contact position between the image bearing member and the cleaning member, and the vent hole.

Further features of the present disclosure will become apparent from the following description of exemplary embodiments with reference to the attached drawings.

DESCRIPTION OF THE EMBODIMENTS

Figure 1:
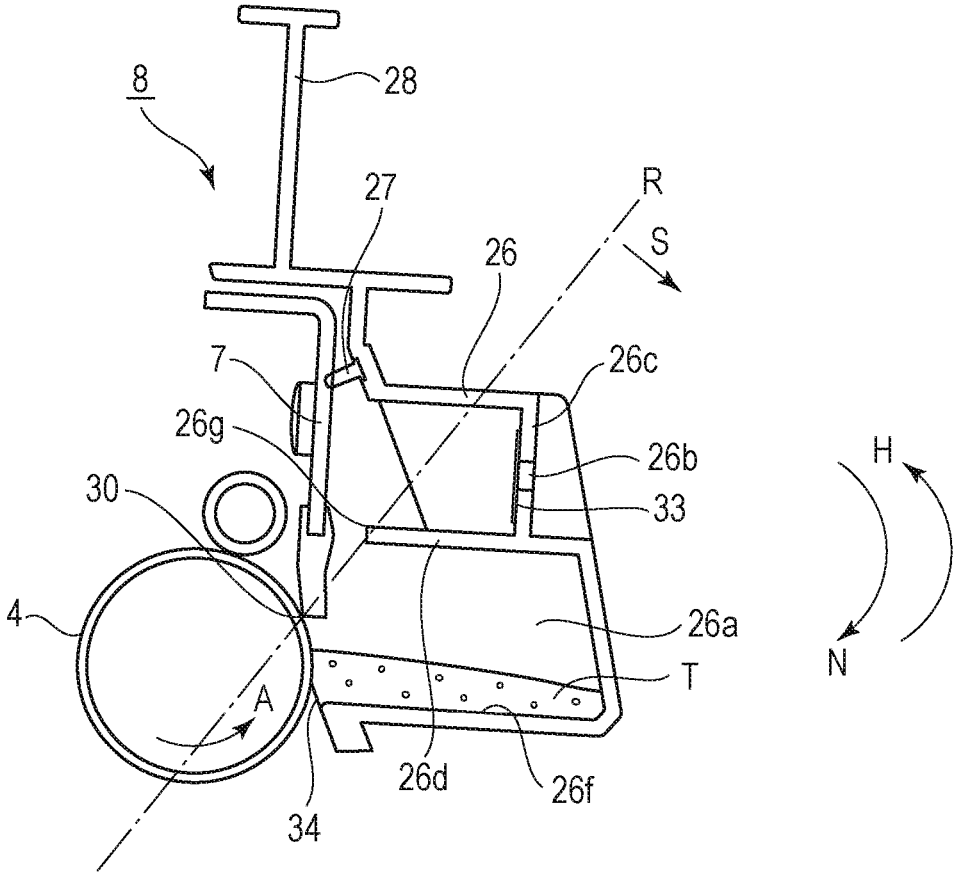
FIG. 1 is a cross-sectional view of a cleaning device according to an exemplary embodiment of the present disclosure.

Hereinafter, referring to the drawings and an exemplary embodiment, the best mode for carrying out the disclosure will be exemplified in detail. Note that unless explicitly stated, the functions, the materials, the shapes, and the relative positions of the components described in the exemplary embodiment do not limit the scope of the disclosure. Furthermore, the functions, the materials, the shapes, and the like that have already been described once in the following description are similar to those initially described unless described again in particular.

Hereinafter, referring to the drawings, an exemplary embodiment of the present disclosure will be described. Note that the following exemplary embodiment exemplifies, as an image forming apparatus, an image forming apparatus in which four process cartridges are detachable therefrom. The number of process cartridges mounted in the image forming apparatus is not limited to the above number. The number is appropriately set as required. Furthermore, in the exemplary embodiment described below, a laser beam printer is exemplified as one of the modes of the image forming apparatus.

Schematic Configuration of Image Forming Apparatus

Figure 2:
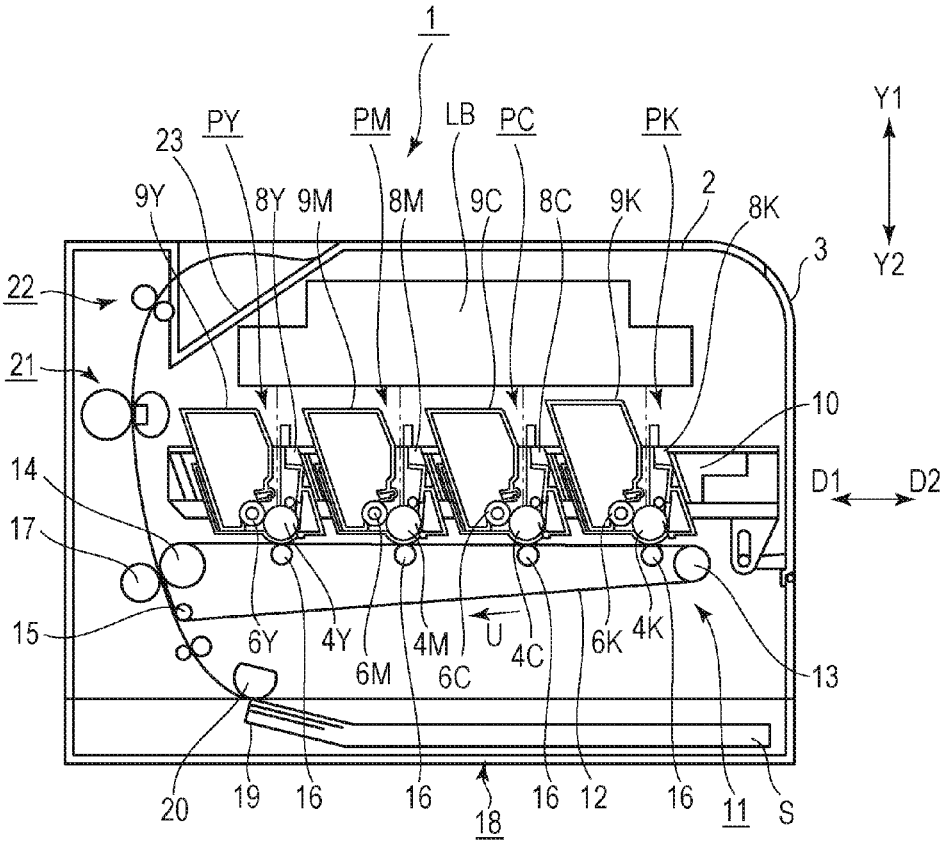
FIG. 2 is a schematic cross-sectional view of the image forming apparatus according to an exemplary embodiment of the present disclosure.
Figure 3:
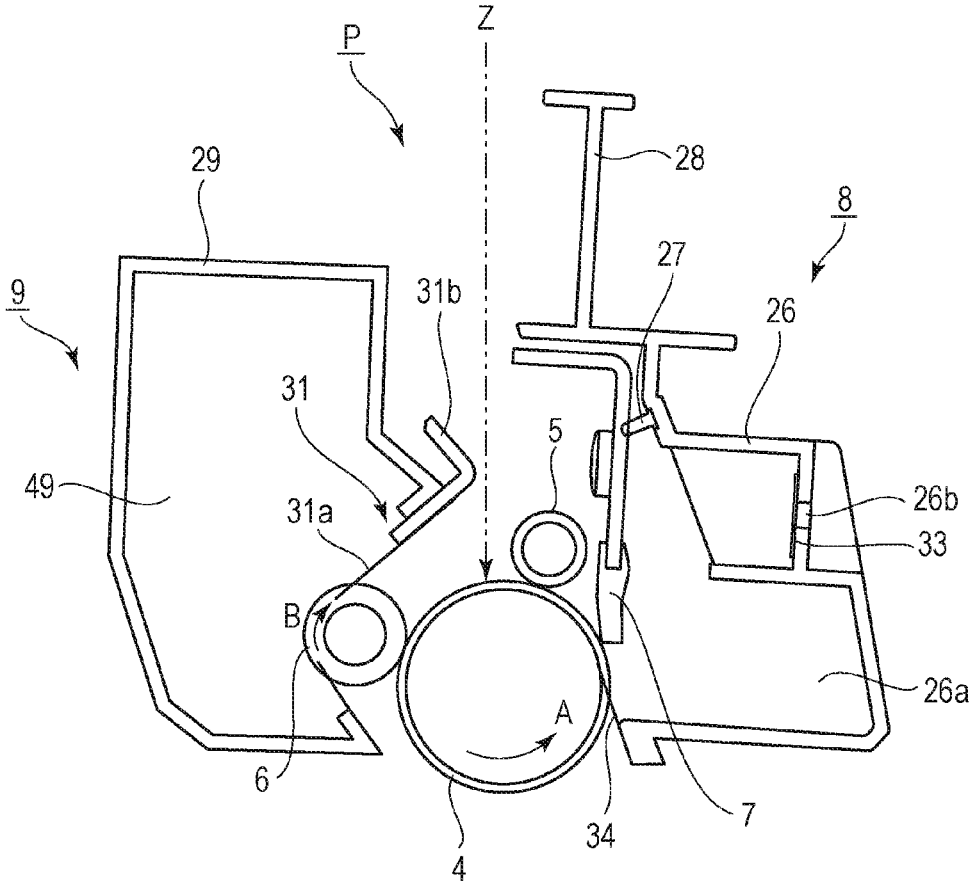
FIG. 3 is a cross-sectional view of a process cartridge according to an exemplary embodiment of the present disclosure.
Figure 4:
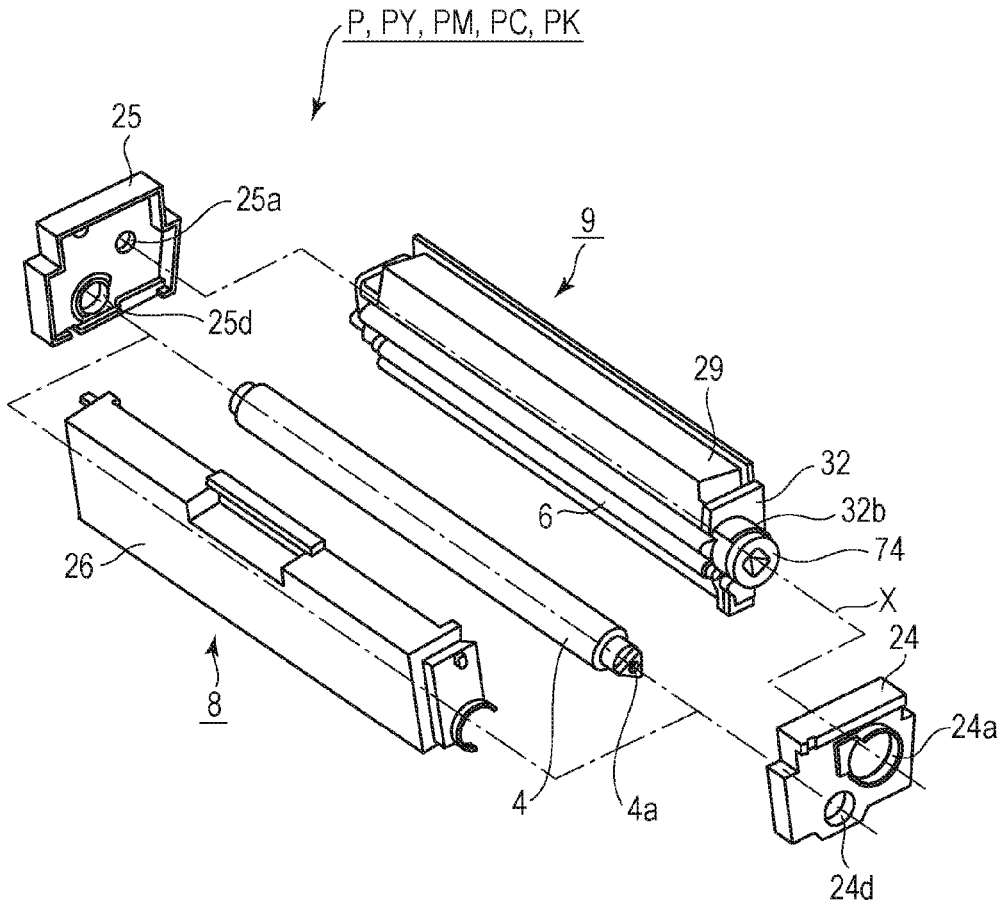
FIG. 4 is an exploded perspective view of the process cartridge according to an exemplary embodiment of the present disclosure.

FIG. 2 is a schematic cross-sectional view of an image forming apparatus 1 according to the exemplary embodiment of the present disclosure. Furthermore, FIG. 3 is a cross-sectional view of a process cartridge P according to the exemplary embodiment of the present disclosure. Furthermore, FIG. 4 is an exploded perspective view of the process cartridge P according to the exemplary embodiment of the present disclosure viewed from a drive side that is a first end side in an axial direction (hereinafter, referred to as a longitudinal direction) of a photosensitive drum 4.

The image forming apparatus 1 is a four full-color laser beam printer employing an electrophotographic process and forms a color image on a recording medium. The image forming apparatus 1 employs a process cartridge system. The process cartridges P are detachable from a main body 2 of the image forming apparatus.

Note that in the image forming apparatus 1, a side on which a front door 3 is provided is the front (a front side), and the side on the other side with respect to the front is the back (a back side). Furthermore, when viewing the image forming apparatus 1 from the front, the right side is referred to as a drive side and the left side is referred to as a non-drive side. FIG. 2 is a cross-sectional view of the image forming apparatus 1 viewed from the non-drive side of the image forming apparatus 1, and in a direction perpendicular to the sheet surface of FIG. 2, the near side is a non-drive side of the image forming apparatus 1, the far side is the drive side of the image forming apparatus 1, and the right side is the front of the image forming apparatus 1.

In the main body 2 of the image forming apparatus, four process cartridges P (PY, PM, PC, and PK), that is, a first process cartridge PY, a second process cartridge PM, a third process cartridge PC, a fourth process cartridge PK are arranged a horizontal direction. Each of the first to fourth process cartridges P (PY, PM, PC, and PK) has a similar electrophotographic processing mechanism, and has a different toner color. Rotational driving force is transmitted from a drive output unit (not shown) of the main body 2 of the image forming apparatus to the first to fourth process cartridges P (PY, PM, PC, and PK). Furthermore, a bias voltage (a charging bias, a developing bias, and the like, not shown) are supplied from the main body 2 of the image forming apparatus to the first to fourth process cartridges P (PY, PM, PC, and PK).

As illustrated in FIG. 3, each of the first to fourth process cartridges P (PY, PM, PC, and PK) of the present exemplary embodiment includes a cleaning device 8 (hereinafter, referred to as a drum unit 8) and a developing device 9 (hereinafter, referred to as a developing unit 9). The drum unit 8 includes an image bearing member 4 (hereinafter, referred to as the photosensitive drum 4), and a charging member and a cleaning member that serve as a process member that acts on the photosensitive drum 4. Meanwhile, the developing unit 9 includes a developer bearing member 6 (hereinafter, referred to as a development roller 6) that develops an electrostatic latent image on the photosensitive drum 4. The drum unit 8 and the developing unit 9 are joined to each other. A further specific configuration of the process cartridge P will be described later.

The first process cartridge PY contains a yellow (Y) toner inside a developer container 29, and forms a yellow toner image on a surface of a photosensitive drum 4. The second process cartridge PM contains a magenta (M) toner inside a developer container 29, and forms a magenta toner image on a surface of a photosensitive drum 4. The third process cartridge PC includes a cyan (C) toner inside a developer container 29, and forms a cyan toner image on a surface of the photosensitive drum 4. The fourth process cartridge PK contains a black (K) toner inside a developer container 29, and forms a black toner image on a surface of the photosensitive drum 4.

As illustrated in FIG. 2, a laser scanner unit LB serving as an exposing member is provided above the first to fourth process cartridges P (PY, PM, PC, and PK). The laser scanner unit LB outputs a laser beam Z corresponding to image information, and the laser beam. Z scans and exposes the surface of the photosensitive drum 4.

An intermediate transfer belt unit 11 serving as a transfer member is provided below the first to fourth process cartridges P (PY, PM, PC, and PK). The intermediate transfer belt unit 11 includes a drive roller 13, a turn roller 14, and a tension roller 15, and a flexible transfer belt 12 is stretched thereacross.

An underside of the photosensitive drum 4 of each of the first to fourth process cartridges P (PY, PM, PC, and PK) is in contact with an upper surface of the transfer belt 12. Each of the above contact portions is a primary transfer portion. Primary transfer rollers 16 are provided inside the transfer belt 12 so as to oppose the photosensitive drums 4.

A secondary transfer roller 17 is abutted against the turn roller 14 with the transfer belt 12 interposed therebetween. A contact portion between the transfer belt 12 and the secondary transfer roller 17 is a secondary transfer portion.

A feed unit 18 is provided below the intermediate transfer belt unit 11. The feed unit 18 includes a feed tray 19 on which recording mediums are stacked and in which the recording mediums are contained, and a feed roller 20.

A fixing unit 21 and a discharge unit 22 is provided in the upper left portion inside the main body 2 of the image forming apparatus in FIG. 2. An upper surface of the main body 2 of the image forming apparatus serves as a discharge tray 23.

A toner image is fixed to a recording medium S with a fixing member provided in the fixing unit 21, and the recording medium S is charged to the discharge tray 23.

Image Forming Operation

An operation of forming a color image is performed in the following manner.

The photosensitive drum 4 of each of the first to fourth process cartridges P (PY, PM, PC, and PK) is first rotationally driven at a predetermined speed in an arrow A direction in the FIG. 3. Furthermore, the transfer belt 12 is also rotationally driven in a forward direction (an arrow U direction in FIG. 2) with respect to the rotation of the photosensitive drum 4 at a speed corresponding to the speed of the photosensitive drum 4.

Furthermore, in each of the process cartridges, the surface of the photosensitive drum 4 charged with a predetermined polarity and potential in a uniform manner with a charging roller 5 is scanned and exposed with a laser beam Z in accordance with the image signal of the relevant color by driving the laser scanner unit LB. With the above, an electrostatic latent image corresponding to the image signal of the relevant color is formed on the surface of the photosensitive drum 4. The electrostatic latent image that has been formed is developed with the development roller 6 that is rotationally driven (an arrow B direction in FIG. 3) at a predetermined speed.

The yellow toner image formed on the photosensitive drum 4 of the first process cartridge PY is primarily transferred onto the transfer belt 12. Similarly, the magenta toner image formed on the photosensitive drum 4 of the second process cartridge PM is superimposed on the yellow toner image that has already been formed on the transfer belt 12 and is primarily transferred. Subsequently, the cyan toner image formed on the photosensitive drum 4 of the third process cartridge PC is superimposed on the yellow and magenta toner images that have already been formed on the transfer belt 12 and is primarily transferred. Finally, the black toner image formed on the photosensitive drum 4 of the fourth process cartridge PK is superimposed on the yellow, magenta, and cyan toner images that have already been formed on the transfer belt 12 and is primarily transferred. A non-fixed toner image of four colors, namely, yellow, magenta, cyan, and black, is formed on the transfer belt 12 in the above manner.

Meanwhile, the recording mediums are separated sheet by sheet and are fed at a predetermined control timing. The recording medium is introduced into a secondary transfer portion that is an abutment portion between the secondary transfer roller 17 and the transfer belt 12 at the predetermined control timing. With the above, during the process in which the recording medium S is conveyed to the secondary transfer portion, the superimposed four-colored toner image on the transfer belt 12 is sequentially transferred onto the surface of the recording medium S. Subsequently, with the fixing member provided in the fixing unit 21, the toner image is fixed to the recording medium S on which the superimposed four-colored toner image has been transferred, and the formation of the image is completed.

Overall Configuration of Process Cartridge

In the present exemplary embodiment, the first to fourth process cartridges P (PY, PM, PC, and PK) each include a similar electrophotographic processing mechanism, and the color of the toner contained and the amount of toner filled in each of the process cartridges P are different.

The process cartridges P include photosensitive drums 4 (4Y, 4M, 4C, and 4K), and process members that act on the photosensitive drums 4. Note that the process members include charging rollers 5 (5Y, 5M, 5C, and 5K), the development rollers 6 (6Y, 6M, 6C, and 6K), and cleaning members 7 (hereinafter, referred to as cleaning blades 7). Each charging roller 5 is a charging member that charges the corresponding photosensitive drum 4, each development roller 6 is a developing member that develops the latent image formed on the corresponding photosensitive drum 4, and each cleaning blade 7 is a cleaning member that removes residual toner remaining on the surface of the corresponding photosensitive drum 4. Furthermore, the process cartridges P are separated into the drum units 8 (8Y, 8M, 8C, and 8K), and the developing units 9 (9Y, 9M, 9C, and 9K).

Configuration of Drum Unit

As illustrated in FIGS. 3 and 4, the drum unit 8 includes the photosensitive drum 4, the charging roller 5, the cleaning blade 7, and a frame 26 (hereinafter, referred to as a cleaner case 26). The photosensitive drum 4 is rotatably supported by a first end side cartridge cover member 24 and a second end side cartridge cover member 25 provided at both ends of the process cartridge P in the longitudinal direction. The first end side cartridge cover member 24 and the second end side cartridge cover member 25 will be described later. Furthermore, as illustrated in FIG. 4, a coupling member 4*a* that transmits driving power to the photosensitive drum 4 is provided at the first end side of the photosensitive drum 4 in the longitudinal direction. The coupling member 4*a* engages with a coupling (not shown) serving as a drum drive output unit of the main body 2 of the image forming apparatus such that driving power of a drive motor (not shown) of the main body 2 of the image forming apparatus is transmitted to the photosensitive drum 4. The charging roller 5 is supported by the cleaner case 26 such that the charging roller 5 in contact with the photosensitive drum. 4 can be driven and rotated. Furthermore, the cleaning blade 7 is supported by the cleaner case 26 such that the cleaning blade 7 is abutted against a peripheral surface of the photosensitive drum 4 at a predetermined pressure. The toner removed from the peripheral surface of the photosensitive drum 4 with the cleaning blade 7 is contained in a waste toner containing unit 26*a* inside the cleaner case 26. A vent hole 26*b* that communicates the inside and the outside of the waste toner containing unit 26*a*, and a filter 33 that covers the vent hole 26*b* from the inside are provided in the waste toner containing unit 26*a*. The vent hole 26*b* and the filter 33 will be described later.

A sealing member 27 is disposed between the cleaner case 26 and the cleaning blade 7 so as to prevent the toner from leaking out from the waste toner containing unit 26*a*. Note that in order to prevent the toner from leaking out from the waste toner containing unit 26*a*, a styrene elastomer resin that is an elastic body with no permeability is used as the material of the sealing member 27. The material of the sealing member 27 may be any other elastomer resin or any material that has a similar mechanical property, or a material such as silicone rubber, soft rubber, hot melt, or any other material that has a similar mechanical property may be used. Furthermore, a sheet member 34 is disposed between the photosensitive drum. 4 and the cleaner case 26 such that the toner is prevented from leaking out from the waste toner containing unit 26*a*. A first end of the sheet member 34 is supported by the cleaner case 26, and a second end thereof is in contact with the photosensitive drum 4. Polyethylene terephthalate (PET) is used as the material of the sheet member 34. The material of the sheet member 34 may be any other material that has a similar mechanical property.

Configuration of Developing Unit

As illustrated in FIG. 3, the developing unit 9 includes the development roller 6, a development blade 31, and the developer container 29. The developer container 29 includes a toner containing unit 49 (49Y, 49M, 49C, or 49K) that contains the toner supplied to the development roller 6, and the development blade 31 that regulates the layer thickness of the toner on the peripheral surface of the development roller 6. The development blade 31 is a member in which a thin metal plate 31*a*, which is a metal sheet of about 0.1 mm thick, is attached to a base metal plate 31*b*, which is a metal material that has an L-shaped cross-section, by welding or the like. The development blade 31 is attached to the developer container 29 with screws screwed to two portions, that is, the first end side and the second end side of the base metal plate 31*b* in the longitudinal direction. The development roller 6 is rotatably supported by bearing-side plates (not shown) that are attached to both ends of the developer container 29 in the longitudinal direction. Furthermore, as illustrated in FIG. 4, a development input coupling 74 that transmits driving power to the developing unit 9 is provided on the first end side of the developing unit 9 in the longitudinal direction. The development input coupling 74 engages with a coupling (not shown) serving as a development drive output unit of the main body 2 of the image forming apparatus such that the driving power of a drive motor (not shown) of the main body 2 of the image forming apparatus is input to the developing unit 9. The driving power input to the developing unit 9 is transmitted by a drive gear train (not shown) provided in the developing unit 9; accordingly, the development roller 6 can be rotated in the arrow B direction in FIG. 3. A development cover member 32, which supports and covers the development input coupling 74 and a drive train (not shown), is provided on the first end side of the developing unit 9 in the longitudinal direction.

Attaching Drum Unit and Developing Unit to Each Other

Referring to FIG. 4, attaching of the drum unit 8 and the developing unit 9 to each other will be described. The drum unit 8 and the developing unit 9 are joined to each other with the first end side cartridge cover member 24 and the second end side cartridge cover member 25 provided at both ends of the process cartridge P in the longitudinal direction. A support hole portion 24*a* that enables the developing unit 9 to move in a pivotal manner is provided in the first end side cartridge cover member 24 provided on the first end side of the process cartridge P in the longitudinal direction. Furthermore, a support hole portion 25*a* that enables the developing unit 9 to move in a pivotal manner is provided in the second end side cartridge cover member 25 provided on the second end side of the process cartridge P in the longitudinal direction. Moreover, bearings 24*d* and 25*d* that rotatably support the photosensitive drum 4 are provided in the first end side cartridge cover member 24 and the second end side cartridge cover member 25. Note that on the first end side, an outer diameter portion of a cylindrical portion 32*b* of the development cover member 32 is fitted in the support hole portion 24*a* of the first end side cartridge cover member 24. On the second end side, a projection (not shown) provided so as to project from the developer container 29 is fitted in the support hole portion. 25*a*, of the second end side cartridge cover member 25. Moreover, both ends of the photosensitive drum 4 in the longitudinal direction are fitted in the bearing 24*d* of the first end side cartridge cover member 24 and the bearing 25*d* of the second end side cartridge cover member 25. Furthermore, the first end side cartridge cover member 24 and the second end side cartridge cover member 25 are fixed to the drum unit 8 with screws, an adhesive, or the like (not shown). With the above, the developing unit 9 is rotatably supported with respect to the drum unit 8 with the first end side cartridge cover member 24 and the second end side cartridge cover member 25, such that development roller 6 can be set at a position where the development roller 6 acts on the photosensitive drum 4 during the image-forming period. Note that the rotational center of the developing unit 9 is an axial line that connects the support hole portion 24*a* of the first end side cartridge cover member 24 and the support hole portion 25*a* of the second end side cartridge cover member 25 to each other, and will be referred to as a pivotal axis X and a pivot center X. Note that the cylindrical portion 32*b* of the development cover member 32 of the first end side is coaxial to the development input coupling 74. In other words, the developing unit 9 is configured so that the driving power is transmitted from the main body 2 of the image forming apparatus at the pivot center X.

Configuration of Cartridge Tray (Support Member)

Figure 6:
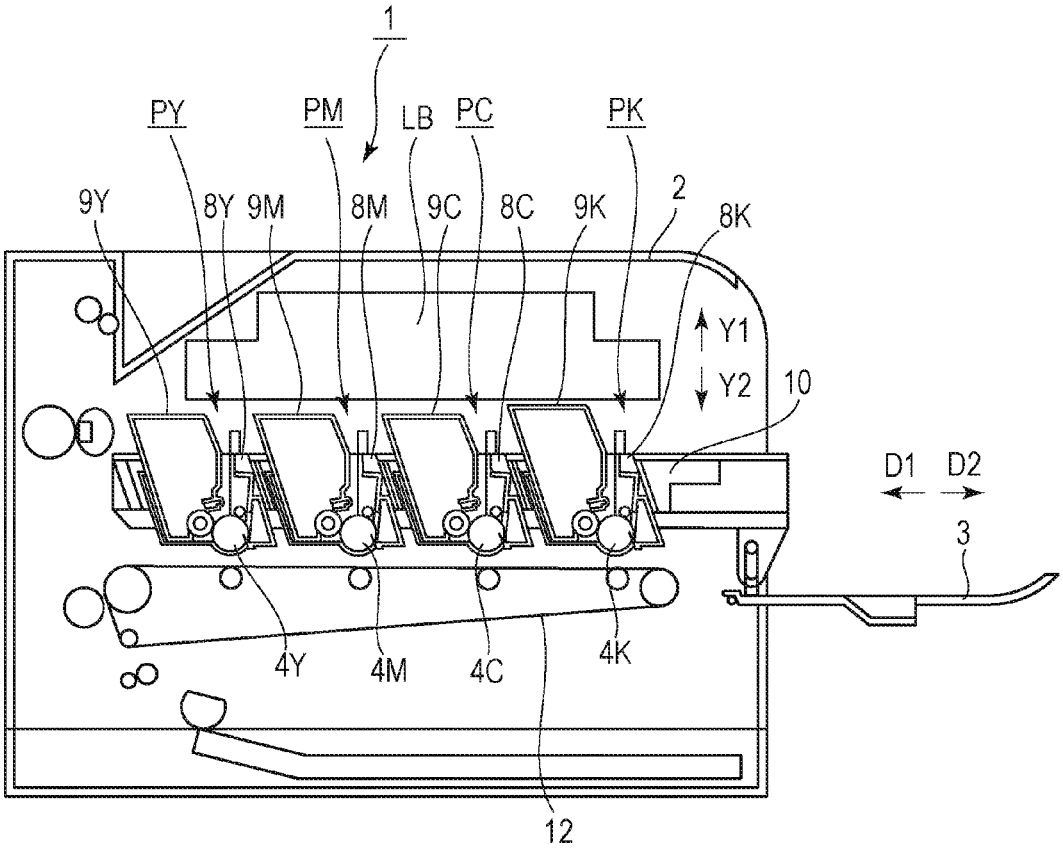
FIG. 6 is a schematic cross-sectional view of the image forming apparatus according to an exemplary embodiment of the present disclosure.
Figure 7:
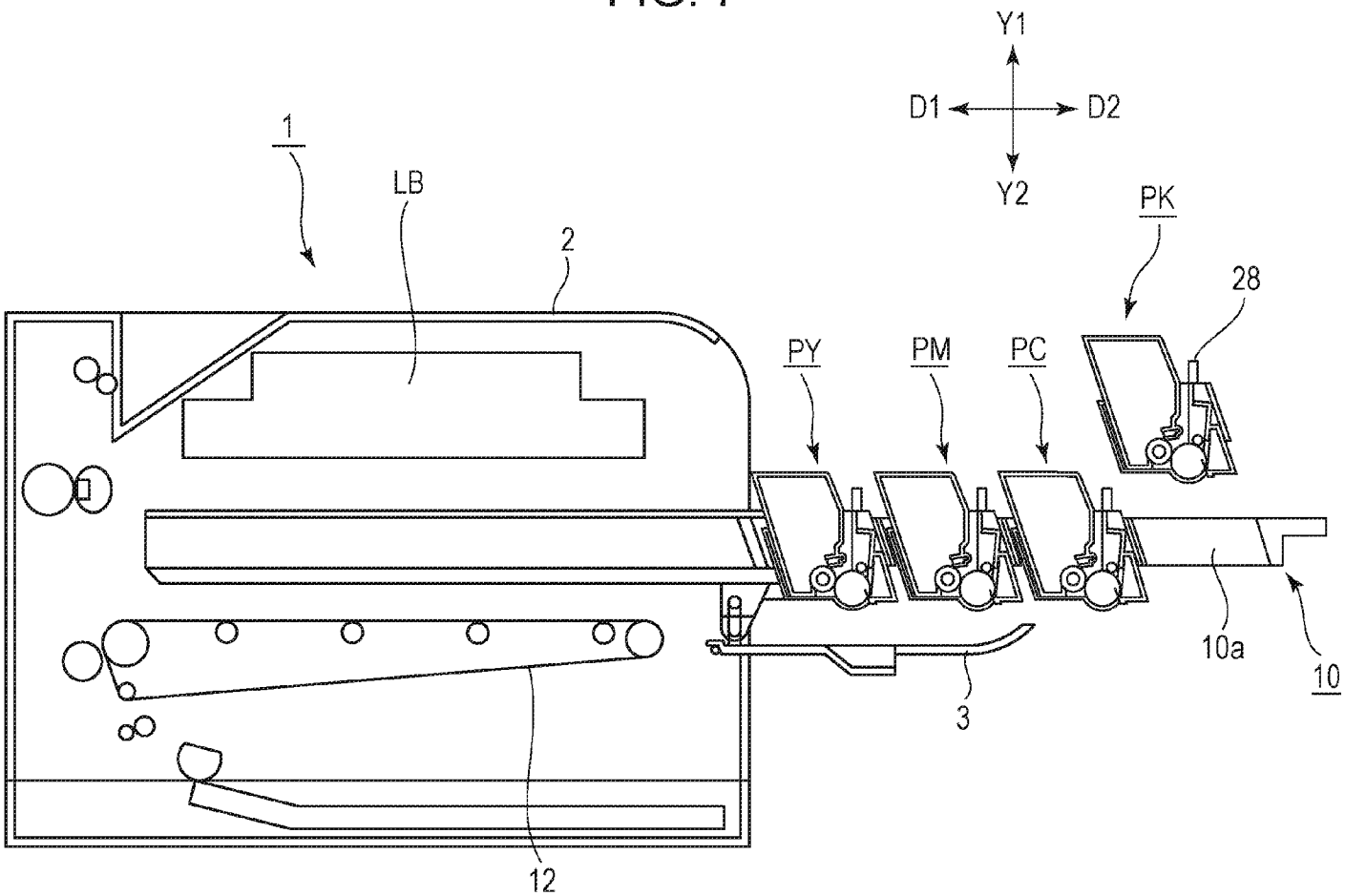
FIG. 7 is a schematic cross-sectional view of the image forming apparatus according to an exemplary embodiment of the present disclosure.

Referring to FIGS. 2, 6, and 7, a cartridge tray (hereinafter, a tray) 10 serving as a support member will be described. FIG. 6 is a cross-sectional view of the image forming apparatus 1 in a state in which the tray 10 is positioned inside the main body 2 of the image forming apparatus. FIG. 7 is a cross-sectional view of the image forming apparatus 1 in a state in which the tray 10 is positioned outside the main body 2 of the image forming apparatus. As illustrated in FIGS. 6 and 7, the tray 10 is capable of moving in an arrow D1 direction (a pushing-in direction) and in an arrow D2 direction (a drawing-out direction) with respect to the main body 2 of the image forming apparatus. In other words, the tray 10 is provided so as to be capable of being drawn out and pushed in with respect to the main body 2 of the image forming apparatus, and the tray 10 is capable of moving between an inside position (FIG. 6) that is a position inside the main body 2 of the image forming apparatus, and an outside position (FIG. 7) that is a position outside the main body 2 of the image forming apparatus. FIG. 2 illustrates a case in which image formation is performed in the state in which the tray 10 is at the inside position. The tray 10 includes a mount portion 10*a* in which the plurality of process cartridges P can be mounted (see FIG. 7). In the state in which the tray 10 is drawn out to the outside position, the process cartridges P move in an arrow Y1 direction (a detaching direction) and an arrow Y2 direction (a mounting direction) and in directions that intersect the moving directions (the arrow D1 and D2 directions) of the tray 10, and are mounted so as to be capable of being dismounted from the mount portion 10*a*. The first end side cartridge cover member 24 and the second end side cartridge cover member 25 are engaged with the tray 10, and the process cartridges P are loaded on the tray 10. Furthermore, while being disposed on the mount portion 10*a*, the process cartridges P enter (are pushed into) the main body 2 of the image forming apparatus together with the tray 10.

The process cartridges P can be mounted and dismounted with respect to the main body of the image forming apparatus in the above manner with the tray 10.

Detailed Description of Drum Unit 8 (Cleaning Device 8)

Figure 5A:
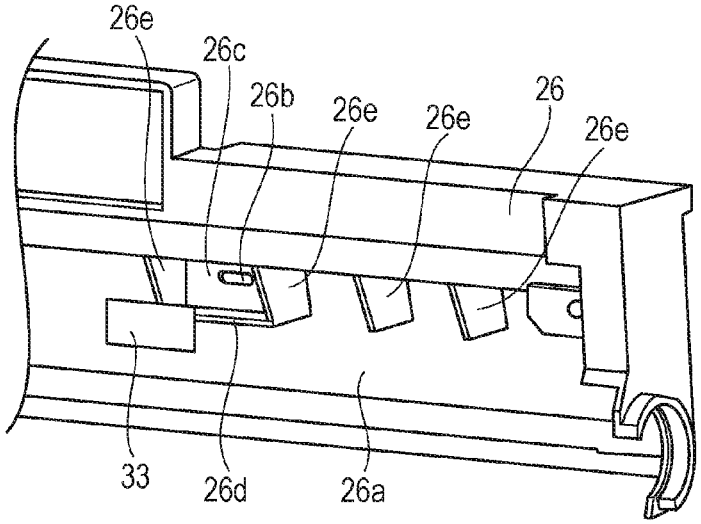
FIGS. 5A and 5B are explanatory drawings of an adhesion method of a filter according to an exemplary embodiment of the present disclosure.
Figure 5B:
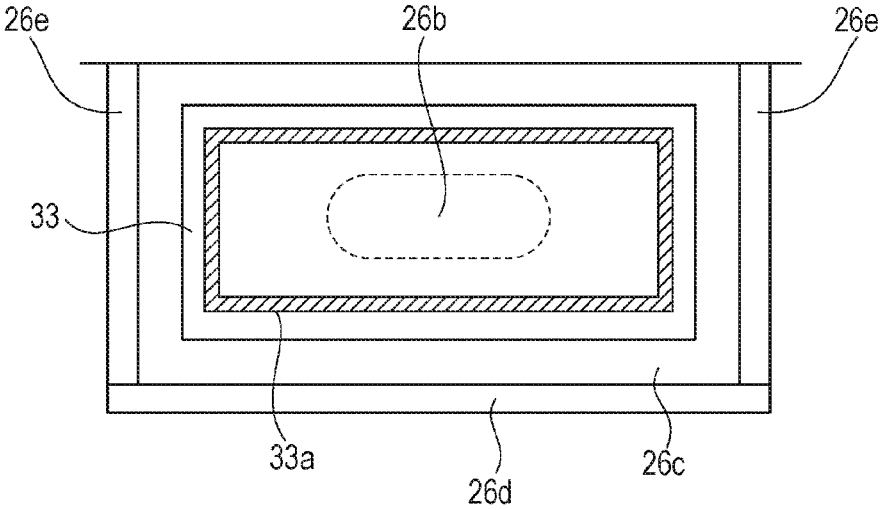

Hereinafter, the drum unit 8 (the cleaning device 8) according to the exemplary embodiment of the present disclosure will be described in detail with reference to FIGS. 1, 5A, and 5B. FIG. 1 is a diagram illustrating a state of the vent hole 26*b* of the drum unit 8 when disposed in the main body 2 of the image forming apparatus, and is a cross-sectional viewed from the non-drive side. FIG. 5A is a perspective view of the cleaner case 26 before the filter 33 is adhered to the vent hole 26*b*. FIG. 5B is an enlarged view of the filter 33 that covers the vent hole 26*b*.

As illustrated in FIGS. 1, 5A, and 5B, the vent hole 26*b* is provided in the waste toner containing unit 26*a* of the cleaner case 26. The vent hole 26*b* is provided in a lateral surface 26*c* of the cleaner case 26 that is a surface that opposes the cleaning blade 7, and in a state in which the drum unit 8 is installed in the main body 2 of the image forming apparatus, the vent hole 26*b* is a hole that penetrates in the horizontal direction. In a state in which the drum unit 8 is installed in the main body 2 of the image forming apparatus, the vent hole 26*b* is provided vertically above a contact position 30 that is where the photosensitive drum 4 and the cleaning blade 7 come in contact with each other. The vent hole 26*b* has a shape of a long hole, and is a hole that communicates the inside of the waste toner containing unit 26*a* and the outside of the cleaner case 26 to each other. The shape of the vent hole 26*b* is not limited to a long hole, and may be any shape that allows air to pass therethrough, such as a circle, a rectangular, a square, and the like.

Moreover, the vent hole 26*b* is covered by the filter 33. The air permeability of the filter 33 may be appropriately set depending on the particle diameter of the toner contained in the waste toner containing unit 26*a*, such that the toner contained in the waste toner containing unit 26*a* does not leak out. Preferably, the material of the filter 33 is polyethylene terephthalate (PET), polyethylene (PE), polypropylene (PP), or the like, and is a non-woven fabric having a thickness of 0.03 to 0.15 mm. Furthermore, even if the material of the filter 33 is not a non-woven fabric, the material may be any material that has holes that are smaller than the particle diameter of the toner contained in the waste toner containing unit 26*a*, and that has a degree of air permeability that prevents the pressure inside the waste toner containing unit 26*a* from increasing. The filter 33 is larger than the vent hole 26*b*, and is disposed from the inner side of the cleaner case 26 so as to cover the vent hole 26*b*. As illustrated in FIG. 5B, the filter 33 that is disposed on the lateral surface 26*c* so as to cover and hide the vent hole 26*b* is heat welded so as to surround the vent hole 26*b*, and the filter 33 is joined to the cleaner case 26 with a welding portion 33*a*. In other words, the welding portion 33*a* is formed so as to surround the vent hole 26*b*. The method of adhesion may be, other than heat welding, a method that uses a two-sided adhesive tape, or the like and may be any other method that is capable of sealing the vent hole 26*b*.

Moreover, a partitioning portion 26*d* that protrudes from the lateral surface 26*c* is provided inside the waste toner containing unit 26*a*. The partitioning portion 26*d* protrudes from the lateral surface 26*c* towards the cleaning blades 7. In a state in which the drum unit 8 is installed in the main body 2 of the image forming apparatus, the partitioning portion 26*d* is positioned vertically above the contact position 30, and is positioned vertically below the lower side of the vent hole 26*b*. In other words, in a state in which the drum unit 8 is installed in the main body 2 of the image forming apparatus, the partitioning portion 26*d* is disposed between the contact position 30 and the vent hole 26*b* in the vertical direction.

Referring to FIG. 1, the vent hole 26*b* is disposed on a vertically lower side (on an arrow S side in FIG. 1) with respect to a line R connecting the contact position 30 and a distal end 26*g*. In other words, by having the partitioning portion. 26*d* protrude from the lateral surface 26*c* of the frame 26 towards the photosensitive drum 4, the toner that has been removed at the contact position 30 and toner T accumulated at the bottom surface 26*f* can be prevented from moving towards the filter 33 covering the vent hole 26*b*.

As illustrated in FIG. 5A, a plurality of reinforcement ribs 26*e* are disposed in the longitudinal direction inside the waste toner containing unit 26*a*. Some of the reinforcement ribs 26*e* are disposed on both sides of the vent hole 26*b* in the longitudinal direction. In other words, the vent hole 26*b* and the filter 33 are surrounded by the partitioning portion 26*d* and the reinforcement ribs 26*e*. With the above, the toner that has been removed at the contact position 30 and the toner T accumulated at the bottom surface 26*f* can be further prevented from moving towards the filter 33 covering the vent hole 26*b*.

As illustrated in FIG. 1, in the drum unit 8 disposed in the main body 2 of the image forming apparatus, the photosensitive drum 4 rotates in the arrow A direction, and the toner remaining on the surface of the photosensitive drum 4 after the transfer is sent into the waste toner containing unit 26*a*. The toner remaining on the surface of the photosensitive drum. 4 is removed at the contact position 30 with the cleaning blades 7. Most of the removed toner, due to its own weight, falls from the contact position 30 and is accumulated on the bottom surface 26*f* of the waste toner containing unit 26*a*. Since toner includes fine particles, there are cases in which some of the toner flies vertically upwards inside the waste toner containing unit 26*a* with respect to the contact position 30 after being removed at the contact position 30. Toner that has filed upwards in the above manner comes into contact with the partitioning portion 26*d* and falls vertically downwards and is accumulated on the bottom surface 26*f* of the waste toner containing unit 26*a*. In other words, the partitioning portion 26*d* prevents the toner that has filed up from the contact position 30 from adhering onto the filter 33 that covers the vent hole 26*b*, and prevents the filter 33 from becoming clogged with the toner and the air permeability from becoming degraded.

Additionally, the rotating photosensitive drum 4 sends the toner to the waste toner containing unit 26*a* and, at the same time, sends a minute amount of air between the sheet member 34 and the photosensitive drum 4 to the waste toner containing unit 26*a*. Furthermore, upon change in the environment in which the image forming apparatus is used, there are cases in which the air inside the waste toner containing unit 26*a* expands due to the difference in temperature between the inside and the outside of the waste toner containing unit 26*a*. Due to the effect described above, even in a case in which the pressure inside the waste toner containing unit 26*a* is about to increase, the increase in the pressure inside the waste toner containing unit 26*a* can be suppressed since the air inside the waste toner containing unit 26*a* is released from the vent hole 26*b* through the filter 33.

Note that the elastic member with no permeability is used as the sealing member 27. In a state in which the drum unit 8 is installed in the image forming apparatus, there may be a case in which the sealing performance of the sheet member 34 becomes poor due to the weight of the toner removed with the cleaning blade 7 when the sheet member 34 is disposed vertically below the cleaning blade 7. Even in such a case, there is a concern of the toner leaking out at the same time as the air leaks out from between the photosensitive drum 4 and the sheet member 34 due to the difference in pressure between the inside of the highly airtight waste toner containing unit 26*a* and the outside of the cleaner case 26. However, by disposing the filter 33 in the waste toner containing unit 26*a*, the increase in pressure inside the waste toner containing unit 26*a* can be suppressed and leakage of the toner to the outside can be prevented. Furthermore, since clogging of the filter 33 with the removed toner can be suppressed, leakage of the toner to the outside can be prevented throughout the lifetime of the process cartridge. In other words, since the sheet member 34 does not have to be increased in thickness in order to prevent the toner from leaking out, the leaking of the toner can be suppressed without increasing the contact pressure between the photosensitive drum 4 and the sheet member 34.

Furthermore, blasting is performed on the surface of the photosensitive drum 4 abutting against the sheet member 34. With the above, abnormal noise generated by the vibration of the sheet member 34 caused by friction between the sheet member 34 and the photosensitive drum 4, and abnormal noise generated by the vibration of the cleaning blade 7 positioned rotationally downstream of the photosensitive drum 4 can be prevented. Other than the above, blasting of the sheet member 34 can suppress the external additive contained in the toner from being held back. As described above, while blasting is an effective measure against abnormal noise caused by the vibration of the sheet member 34 and the cleaning blades 7, the rigidity of the sheet member 34 decreases and the contact pressure against the photosensitive drum 4 decreases, such that there is a case in which the sealing performance becomes poor.

In such a case, there is a concern of the toner leaking out at the same time as the air leaks out from between the photosensitive drum 4 and the sheet member 34 due to the difference in pressure between the inside of the highly airtight waste toner containing unit 26*a* and the outside of the cleaner case 26. However, by disposing the filter 33 in the waste toner containing unit 26*a*, the increase in pressure inside the waste toner containing unit 26*a* can be suppressed and leakage of the toner to the outside can be prevented. Furthermore, since clogging of the filter 33 with the removed toner can be suppressed, leakage of the toner to the outside can be prevented throughout the lifetime of the process cartridge. In other words, since the sheet member 34 does not have to be increased in thickness in order to prevent the toner from leaking out, the leaking of the toner can be suppressed without increasing the contact pressure between the photosensitive drum 4 and the sheet member 34.

Note that while a case in which blasting is performed on the sheet member 34 and the contact pressure against the photosensitive drum 4 is decreased has been described, the present exemplary embodiment is effective in other cases such as a case in which the contact pressure against the photosensitive drum 4 is decreased by reducing the thickness of the sheet member 34.

Additionally, in the configuration according to the present exemplary embodiment, clogging of the filter 33 can be prevented even when the drum unit 8 that has been used and in which the waste toner containing unit 26*a* is filled with toner is dismounted from the main body of the image forming apparatus and the position thereof is changed. It is assumed that, as a case in which the drum unit 8 that has not been fully used is dismounted from the main body of the image forming apparatus, a case in which the process cartridge that has not reached the end of its lifetime is dismounted from the main body of the image forming apparatus to perform maintenance. Furthermore, it is assumed that the user may, by mistake, dismount a process cartridge that has not reached the end of its lifetime when replacing a process cartridge of a different color that has reached the end of its lifetime. Such a dismounted process cartridge is assumed to be placed at a position that is different from the position when installed in the main body of the image forming apparatus since the dismounted process cartridge is placed outside the main body of the image forming apparatus in a random manner.

Figure 8A:
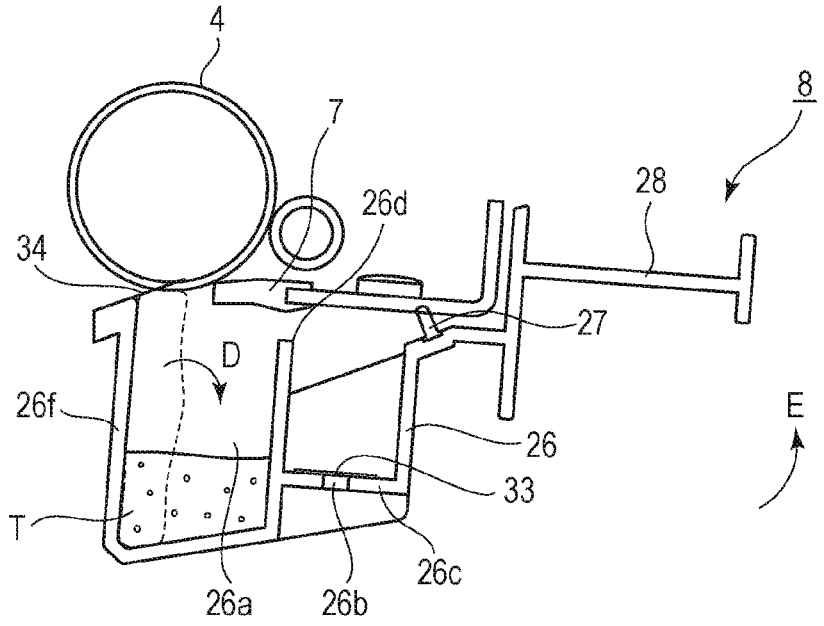
FIGS. 8A and 8B are cross-sectional views of a cleaning device according to an exemplary embodiment of the present disclosure.
Figure 8B:
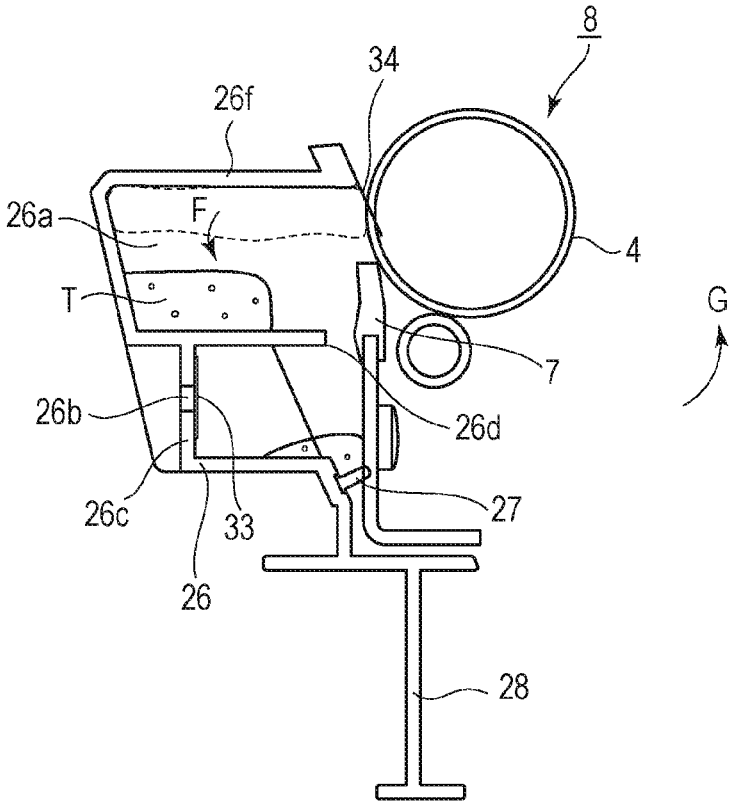

FIG. 8A illustrates a case in which the drum unit 8 is rotated 90 degrees in an arrow N direction in FIG. 1 from the installed position and in which the cleaner case 26 is positioned on the vertically lower side. FIG. 8B illustrates a case in which the drum unit 8 is, from the installed position, rotated 180 degrees in an arrow N direction in FIG. 1 and is positioned thereat.

As illustrated in FIG. 8A, in a case in which the drum unit 8 is dismounted and is placed at a position rotated 90 degrees in the arrow N direction in FIG. 1 from the installed position, the toner T that has been accumulated in a broken line portion in the waste toner containing unit 26*a* moves in an arrow D direction in FIG. 8A due to its own weight. In so doing, the partitioning portion 26*d* becomes an obstacle for the toner T moving to the filter 33 such that the toner T is prevented from moving near the filter 33 and from adhering to the filter 33.

Furthermore, even when the drum unit 8 is rotated 90 degrees in an arrow E direction from the state illustrated in FIG. 8A and is returned to the main body of the image forming apparatus, the drum unit 8 can be installed in the main body 2 of the image forming apparatus without the filter 33 becoming clogged with the toner T.

Additionally, in a case in which the drum unit 8 is rotated 90 degrees in an arrow H direction from the installed position illustrated in FIG. 1, the filter 33 is positioned on the vertically upper side; accordingly, the filter 33 is not clogged by the toner T that is accumulated on the vertically lower side with its own weight. Furthermore, in a case in which the position of the drum unit 8 is changed by attachment and detachment of the drum unit 8, even when a certain amount of vibration in the longitudinal direction is applied to the drum unit 8, the reinforcement ribs 26*e* disposed on both sides of the filter 33 in the longitudinal direction prevent the toner from moving to the filter 33, and clogging of the filter 33 is prevented.

Note that as illustrated in FIG. 8B, a gripper 28 is positioned vertically below such that the drum unit 8 is not easily positioned upside down. Even so, in a case in which the drum unit 8 is dismounted and is placed at a position rotated 180 degrees in the arrow N direction from the state illustrated in FIG. 1, the toner T that had been accumulated in the broken line portion in the waste toner containing unit 26*a* moves in an arrow F direction in FIG. 8B by its own weight. Even in such a case as well, most of the toner T that had been accumulated in the broken line portion in FIG. 8B moves onto the partitioning portion 26*d*. Since the toner does not move near the filter 33 disposed vertically under the partitioning portion 26*d*, the toner T does not adhere to and does not clog the filter 33.

Furthermore, even when the drum unit 8 is rotated 180 degrees in an arrow G direction from the position illustrated in FIG. 8B and is, as the installation position, returned to the main body 2 of the image forming apparatus, the drum unit 8 can be installed in the main body 2 of the image forming apparatus without the filter 33 becoming clogged with the toner T.

As described above, in the drum unit 8 having the present configuration, in a state in which the toner is contained in the waste toner containing unit 26*a*, the filter 33 does not become clogged owing to the partitioning portion 26*d* even when the drum unit 8 is dismounted from the main body of the image forming apparatus and there is a change in the position of main body of the image forming apparatus. Even after the drum unit 8 has been returned to the main body of the image forming apparatus, there is no decrease in the air permeability of the filter 33, and increase in pressure inside the waste toner containing unit 26*a* can be prevented. While a case in which the partitioning portion 26*d* and the frame 26 are integral has been described, the partitioning portion 26*d* may be a separate component.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-129045 filed Jun. 29, 2016, which is hereby incorporated by reference herein in its entirety.

What is claimed is:

1. A cleaning device detachable from an image forming apparatus, the cleaning device comprising:

an image bearing member;

a cleaning member that removes toner on the image bearing member; and a frame that rotationally supports the image bearing member, and that supports the cleaning member, wherein the frame includes a waste toner containing unit that contains the toner removed with the cleaning member, a vent hole that penetrates the frame in a direction crossing to the vertical direction in the state in which the cleaning device is mounted in the image forming apparatus, the vent hole communicates an inside and an outside of the waste toner containing unit and is covered with a filter, and the vent hole includes a first opening that is provided on an inside surface of the frame and a second opening that is provided on an outside surface that is a back side to the inside surface of the frame, and a partitioning portion that protrudes from the inside surface of the frame (26) where the first opening is provided, inside the waste toner containing unit, and wherein in a state in which the cleaning device is mounted in the image forming apparatus, the partitioning portion is, in a vertical direction, positioned between a contact position between the image bearing member and the cleaning member, and the vent hole.

2. The cleaning device according to claim 1, wherein the vent hole is provided vertically above the contact position.

3. The cleaning device according to claim 1, wherein in the state in which the cleaning device is mounted in the image forming apparatus, the vent hole is a hole that penetrates the frame in a horizontal direction.

4. The cleaning device according to claim 1, further comprising, a sealing member disposed between the cleaning member and the frame, the sealing member including an elastic member that has air permeability that is lower than air permeability of the filter.

5. The cleaning device according to claim 1, further comprising, a sealing member disposed between the cleaning member and the frame, the sealing member including an elastic member that has no air permeability.

6. The cleaning device according to claim 1, further comprising, a sheet member, a first end of the sheet member being supported by the frame, and a second end of the sheet member abutting against the image bearing member, wherein a surface of the sheet member has been blasted.

7. A process cartridge detachable from an image forming apparatus, the process cartridge comprising:

the cleaning device according to claim 1; and an integral developing device that includes at least a developer bearing member that develops an electrostatic latent image on the image bearing member.

8. The cleaning device according to claim 1, wherein the central line of the vent hole is a straight line.

9. The cleaning device according to claim 1, wherein the frame has a top wall portion, a bottom wall portion and a side wall portion which is located between the top wall portion and the bottom wall portion and which connects the top wall portion with the bottom wall portion, in the state in which the cleaning device is mounted in the image forming apparatus, and wherein the vent hole is provided on the side wall portion of the frame.

10. The cleaning device according to claim 1,

Wherein the partition portion (26*d*) has a first partition wall, a second partition wall and a third partition wall, The first opening is positioned to be surrounded by the first partition wall, the second partition wall, the third partition wall and the frame.

* * * * *